US008434822B2

(12) United States Patent
Asbjørnsen

(10) Patent No.: US 8,434,822 B2
(45) Date of Patent: May 7, 2013

(54) FURNITURE DEVICE WITH ADJUSTABLE ANGLE BETWEEN THE SEAT AND THE BACK OF THE PIECE OF FURNITURE

(75) Inventor: Svein Asbjørnsen, Sykkylven (NO)

(73) Assignee: SAPDesign AS, Sykkylven (NO)

( * ) Notice: Subject to any disclaimer, the term of this patent is extended or adjusted under 35 U.S.C. 154(b) by 662 days.

(21) Appl. No.: 12/531,074

(22) PCT Filed: Mar. 12, 2008

(86) PCT No.: PCT/NO2008/000093

§ 371 (c)(1),
(2), (4) Date: Jan. 26, 2010

(87) PCT Pub. No.: WO2008/111848

PCT Pub. Date: Sep. 18, 2008

(65) Prior Publication Data

US 2010/0171343 A1 Jul. 8, 2010

(30) Foreign Application Priority Data

Mar. 13, 2007 (NO) ..... 20071348

(51) Int. Cl.
*A47C 1/024* (2006.01)

(52) U.S. Cl.
USPC ..... 297/316; 297/320; 297/321; 297/300.3; 297/61

(58) Field of Classification Search ..... 297/61, 297/316, 320, 321, 323, 300.3
See application file for complete search history.

(56) References Cited

U.S. PATENT DOCUMENTS 2,961,035 A 11/1960 Lorenz
4,840,426 A 6/1989 Vogtherr et al.

(Continued)

FOREIGN PATENT DOCUMENTS

CH 529 537 12/1972
DE 3530868 3/1987

(Continued)

OTHER PUBLICATIONS espacent abstract of DE 3530868 A1.

(Continued)

*Primary Examiner* — Anthony D Barfield
(74) *Attorney, Agent, or Firm* — Ladas & Parry LLP

(57) ABSTRACT

A device for an adjustable piece of seating and reclining furniture with an adjustable angle between the seat and the back of the piece of furniture, wherein on each side of the piece of furniture there is located a fitting projecting upwards from its base, the seat being tiltable about a forward suspension point on the fitting, and the back being tiltable about a rear suspension point on the fitting, wherein the back upon tilting backwards causes the seat to tilt backwards in that a link is pivotally fastened to a rear part of the seat frame and pivotally fastened to a lower part of the back frame, the pivotal connection of the link to the back frame being located behind and below said rear suspension point. On an increase in the angle between the seat and the back, the angle that the neck rest of the piece of furniture forms with the back is reduced. When the piece of seating and reclining furniture is equipped with a foot/leg rest, an activator for this rest and an activator for changing said angle between the seat and the back are controllable by one single, common control lever or control handle.

10 Claims, 6 Drawing Sheets

U.S. PATENT DOCUMENTS

| | | | | |
|---|---|---|---|---|
| 5,918,942 | A * | 7/1999 | Olsen | 297/321 X |
| 6,517,156 | B1 | 2/2003 | Lin | |
| 6,840,575 | B2 | 1/2005 | Hesse | |
| 7,594,693 | B2 * | 9/2009 | Ekornes et al. | 297/61 X |
| 2005/0200181 | A1 | 9/2005 | Dehli | |
| 2006/0061177 | A1 | 3/2006 | Billger et al. | |

FOREIGN PATENT DOCUMENTS

| | | | |
|---|---|---|---|
| EP | 0 309 804 | A2 | 4/1989 |
| EP | 0 399 251 | A1 | 11/1990 |
| EP | 1 074 237 | | 2/2001 |
| EP | 1 118 293 | A2 | 7/2001 |
| EP | 1 188 866 | | 3/2002 |
| EP | 1 256 294 | A2 | 11/2002 |
| EP | 1 736 077 | A1 | 12/2006 |
| NO | 314 563 | B1 | 1/2001 |

OTHER PUBLICATIONS espacent abstract of EP 1074237 A2.

Supplementary European Search Report dated Nov. 10, 2011 for Application No. EP 08 72 3985.

espacenet English abstract of EP 1 256 294 A2.

espacenet English abstract of EP 0 399 251 A1.

* cited by examiner

FURNITURE DEVICE WITH ADJUSTABLE ANGLE BETWEEN THE SEAT AND THE BACK OF THE PIECE OF FURNITURE

The present invention relates to a device for an adjustable piece of seating and reclining furniture with an adjustable angle between the seat and the back of the piece of furniture, wherein on each side of the piece of seating and reclining furniture there is located a fitting projecting up from the base of the piece of furniture, the seat being tiltable about a forward suspension point on the fitting, and the back being tiltable about a rear suspension point on the fitting, wherein the back upon tilting backwards causes the seat to tilt backwards, as disclosed in the preamble of attached claim 1.

According to the invention, the device is also related to aspects wherein:

- the piece of furniture is equipped with a neck rest;
- the piece of furniture is equipped with a leg rest that is pivotally connected to a forward part of the seat frame;
- a first actuator, for example, a gas spring, is controllable to cause said angle adjustment, and wherein a second activator, for example, a gas spring, is controllable to cause tilting up of the leg rest; and
- the piece of furniture has arm rests.

The term "adjustable piece of seating and reclining furniture" is understood here and in the following to mean primarily an adjustable chair, but as an alternative or a supplement also at least an adjustable seating and reclining means in a sofa construction, or a type of temporary bed or a piece of resting furniture on which it is possible for the user of the piece of furniture to assume a sitting position, a lying position or positions in between.

To illustrate the prior art, reference is made to U.S. Pat. No. 5,263,767. Furthermore, reference will also be made to U.S. Pat. No. 4,840,426, DE 3530868, US 20060061177, EP 1074237, U.S. Pat. No. 6,840,575, EP 1188866 and U.S. Pat. No. 2,961,035.

One of the objects of the present invention has been to allow a piece of seating and reclining furniture, which has an adjustable angle between the seat and the back of the piece of furniture, to have the possibility of being equipped with automatic foot/leg rests or of being without such foot/leg rests. This means that the same connecting mechanism between seat and back will be capable of being used. In relation to the difficulties of adjustment in said U.S. Pat. No. 5,263,767, it is another object of the invention to permit easier adjustment of the inclination of the seat relative to the floor and thus seat height from the floor, and correct angle of use in relation to the back.

Furthermore, it is an object of the invention to assure, through the use of simple mechanisms, good interaction between the movements of the seat and the back when the angle between them is changed, so that the seat is not tilted forward when the back is tilted backwards, but that by selecting and positioning such a mechanism, better functionality and better user experience are assured for the user.

In addition, it has been an object in relation to the invention to provide a simple neck rest mechanism which is activated when there are changes in angle between the seat and the back so as to be able to give the user of the piece of furniture a comfortable and not least functionally correct neck support.

A common problem with adjustable pieces of seating and reclining furniture is that there is often a large number of handles and wheels for controlling the adjustment of the piece of furniture, for example, to adjust the angle between the seat and the back, or to put the foot/leg rest in the right position. Often handles for such operations are found either on the same side of the piece of furniture or on both sides thereof, but a common feature of the solutions is that these handles are awkward to operate, and not least it is often difficult for the user to remember exactly which of several handles is the control for a respective adjustment mechanism on the piece of seating and reclining furniture. Therefore, one of the objects of the present invention is to find a simple solution to this problem in connection with the piece of seating and reclining furniture.

With adjustable pieces of seating and reclining furniture of this type, it has in addition been a disadvantage that the arm rest usually remains in the same position, even if the angle between the seat and the back increases substantially. This is at times found to be awkward and in some cases uncomfortable, and one of the objects of the invention is also to solve this problem.

According to the invention, the aforementioned device is characterised in that a link is pivotally fastened to a rear part of the seat frame and pivotally fastened to a lower part of the back frame, the pivotal connection of the link to the back frame being located behind and below said rear suspension point.

According to one embodiment of the device, the forward suspension point is located higher than the rear suspension point According to another embodiment, the pivotal connection of the link to the seat frame is located flush approximately in the region of the rear suspension point, preferably at a short distance above and/or behind the rear suspension point.

According to an embodiment of the device that is related to the piece of furniture having a neck rest, a neck rest is arranged on the back of the piece of seating and reclining furniture in that the neck rest has a frame which is hinge-connected to an upper part of the chair back, the neck rest frame at the hinge connection with the back having a forward facing arm which forms an articulated connection with a rod extending down along the back, the rod at its lower end being articulated to an upright arm attached to the rear part of the seat frame, so that an increase in the angle between the seat and the back tilts the neck rest forwards about the hinge connection to the back relative to the back.

In an alternative embodiment of the device that is related to the piece of furniture having a neck rest, a neck rest is arranged on the chair back in that the neck rest has a frame that is hinge-connected to an upper part of the chair back, the neck rest frame at the hinge connection with the back having a forward facing arm which forms an articulated connection with a rod extending down along the back, the rod at its lower end being articulated to a forward facing arm on an elongate fitting, which fitting close to this arm is pivotally connected to the back frame, the fitting extending forwards towards the forward part of the seat and there being articulated to a tiltable leg rest frame, which leg rest frame is pivotally connected to the forward part of the seat frame, so that on an increase of the angle between the seat and the back, the neck rest is caused to tilt forwards about the hinge connection, whilst the leg rest tilts up.

To facilitate operation of the piece of seating and reclining furniture when it is provided with a leg rest that is pivotally connected to a forward part of the seat frame, the device is equipped with a first actuator, for example, a gas spring, which is controllable to cause said angle adjustment between the seat and the back of the piece of furniture, and a second actuator, for example, a gas spring, which is controllable to cause upward tilting of the leg rest, and wherein said first and second actuators are controllable from one single, common control lever or control handle via a control fitting which has manipulator cable run to each actuator. Advantageously, the leg rest is spring-biased in connection to a dead centre linkage construction.

It is also important in connection with such an adjustable piece of seating and reclining furniture that it has suitable arm rests which feel comfortable to use for the user of the piece of furniture, regardless of the selected mutual angle between the seat and the back, and according to one embodiment, these arm rests are each configured as a hoop-like, forward facing frame, the frame having a rear part which at the top is pivotally fastened to a first end of a connecting link, the second end of the connecting link being pivotally to fastened to the back frame, the rear part of the back frame at the bottom being pivotally connected to a fitting which extends upwards from the base of the piece of furniture.

In one particular embodiment, it is conceived that the frame of the arm rest has a D-like configuration, where the upright of the D has a backward tilted position, the upright at its upper end being pivotally fastened to a first end of a connecting link, the second end of the connecting link being pivotally fastened to the back frame, wherein the arm rest at a distance forward of the lower end of the upright is pivotally connected to a fitting that extends up from the chair base, and wherein the D has a curved portion that faces upwards to form a resting portion for a chair user's arm.

The invention will now be described in more detail with reference to the attached drawings.

Figure 1:
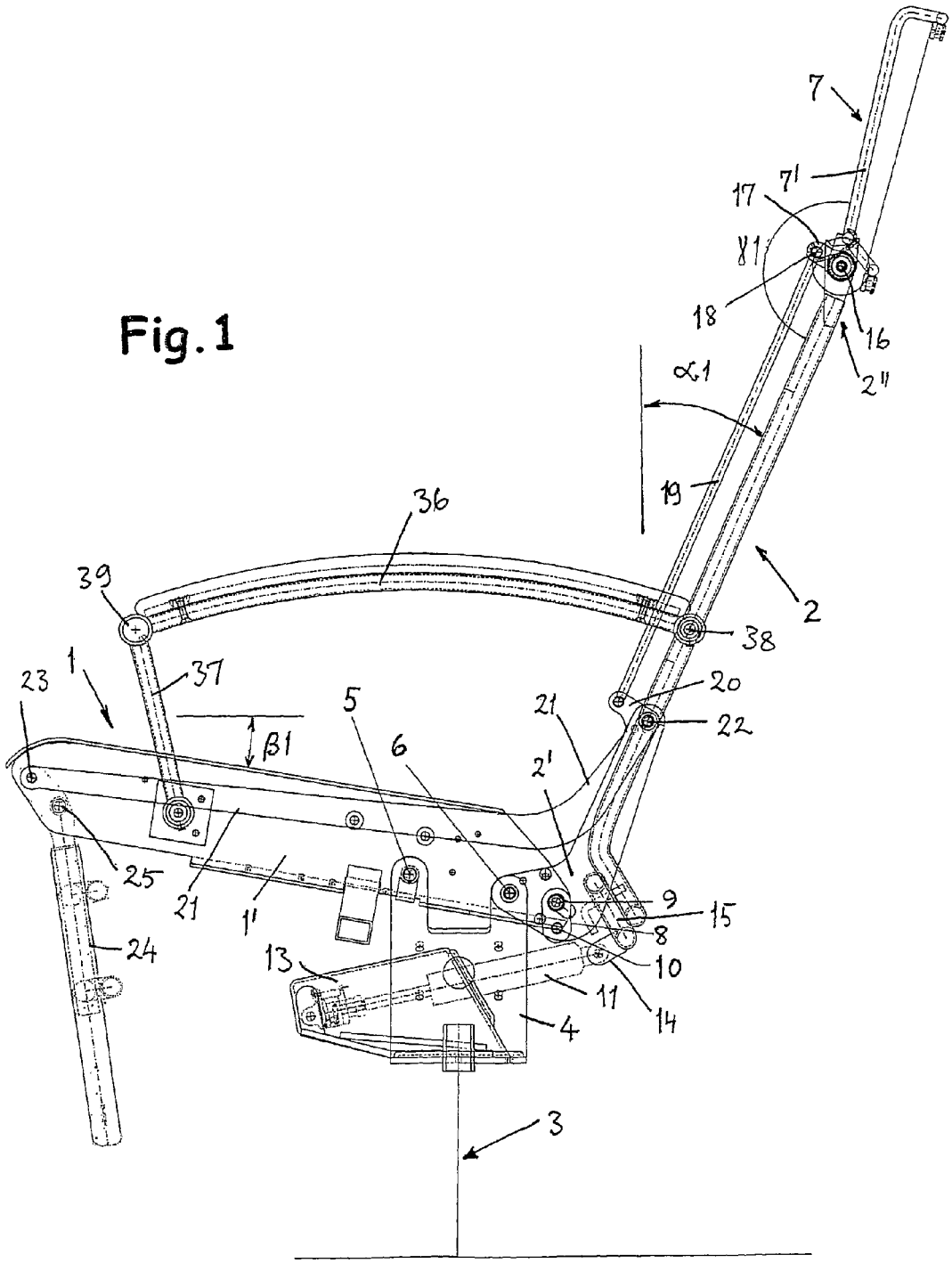
FIG. 1 is a side view of a first schematic diagram of an adjustable piece of seating and reclining furniture according to the invention, with foot/leg rest and with the seat and the back in a first position relative to one another.
Figure 2:
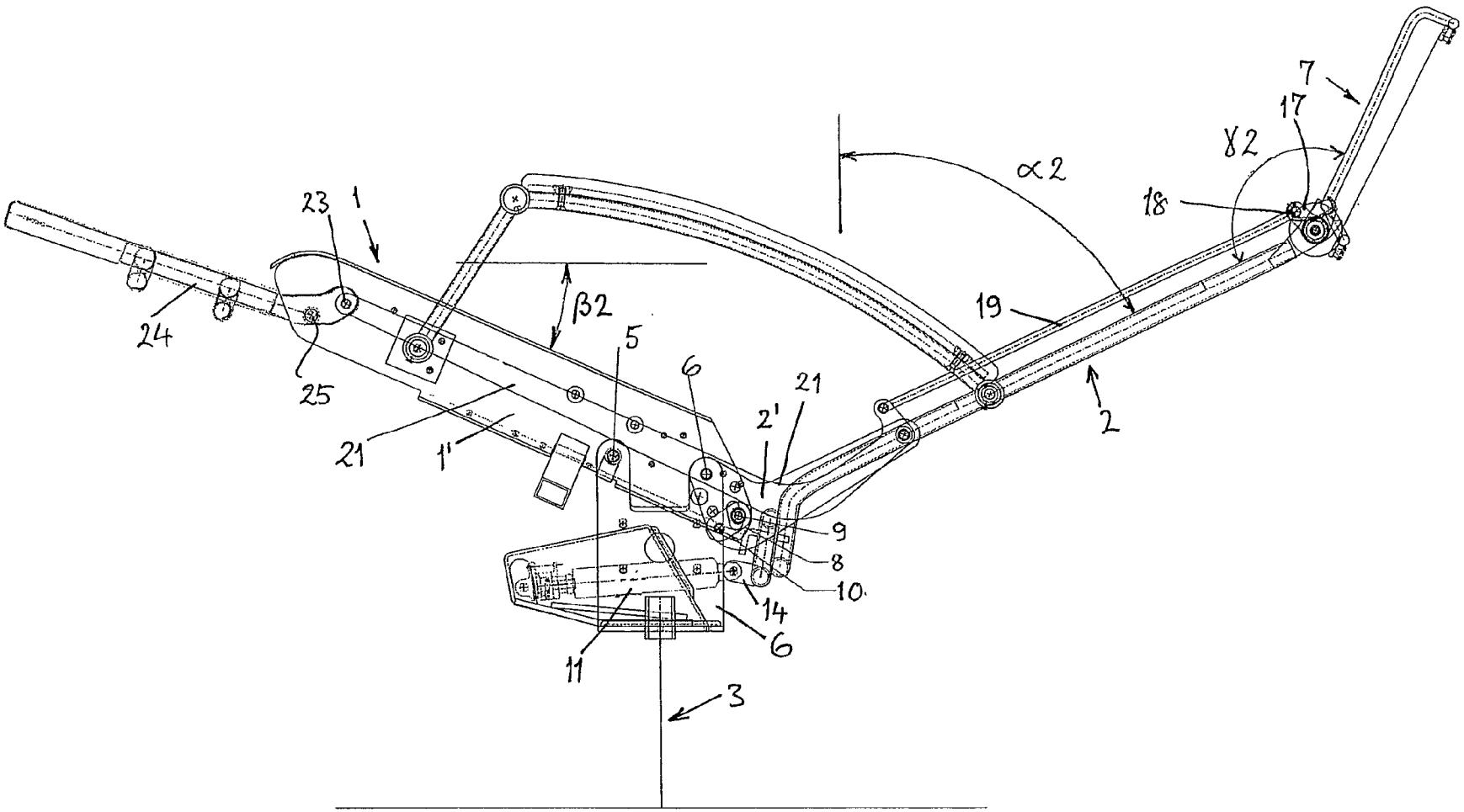
FIG. 2 shows the piece of seating and reclining furniture in FIG. 1 with the seat and the back in a second position relative to one another.

FIGS. 1 and 2 show an adjustable piece of seating and reclining furniture where the angle between the seat 1 and the back 2 of the piece of furniture is selectable and steplessly adjustable. On each side of the piece of furniture there is located a fitting 4 extending up from its base 3. The seat is tiltable about a forward suspension point 5 on the fitting 4, whilst the back is tiltable about a rear suspension point 6 on the fitting 4. It will be seen that the forward suspension point 5 is located higher than the rear suspension point 6.

When the back 2 is caused to tilt backwards, for example, from an angle al relative to the vertical as shown in FIG. 1 to an angle $\alpha 2$ as shown in FIG. 2, this will cause the seat to tilt backwards relative to this, for example, from an angle $\beta 1$ as shown in FIG. 1 to an angle $\beta 2$ as shown in FIG. 2. For the case where said piece of seating and reclining furniture is provided with a neck rest 7, the angle that the neck rest 7 forms with the back 2 is caused to change from, for example, an angle $\gamma 1$ as shown in FIG. 1 to an angle $\gamma 2$ as shown in FIG. 2.

In the illustrated example $\alpha 1$=23.7°; $\alpha 2$=63.9°; $\beta 1$=9.4°; $\beta 2$=23.4°; $\gamma 1$=169.5°; $\gamma 2$=141.1°. These are the currently preferred, mutually related angle values, but it will be understood that the mutual angle ratios, i.e., $\alpha 1$: $\oplus 1$: $\gamma 1$ and $\alpha 2$: $\beta 2$: $\gamma 2$, may of course be changed due to requirements, fine adjustment possibilities and structural changes.

Figure 3:
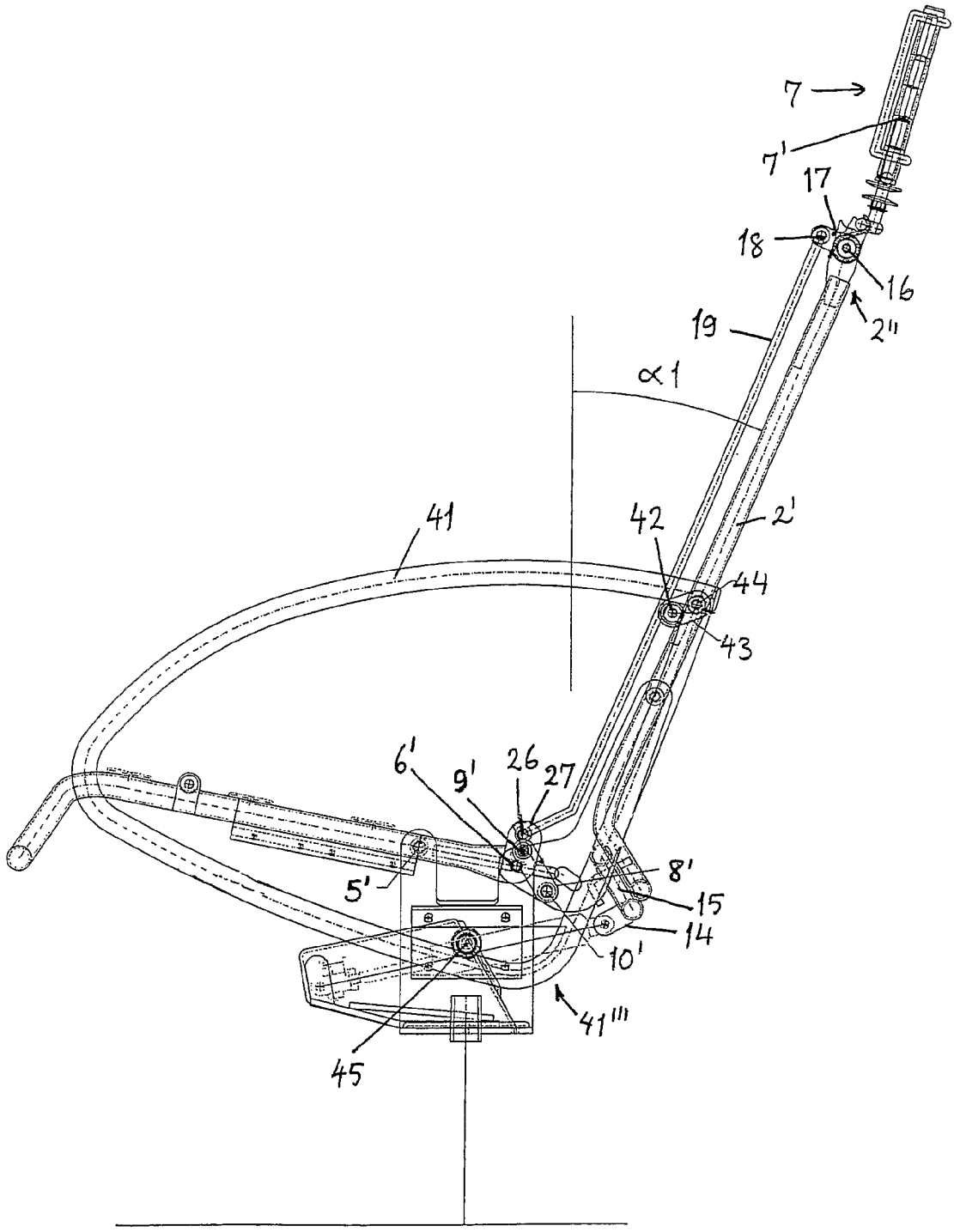
FIG. 3 is a side view of a second schematic diagram of an adjustable piece of seating and reclining furniture according to the invention, without foot/leg rest and with the seat and the back in a first position relative to one another
Figures 4, 5:
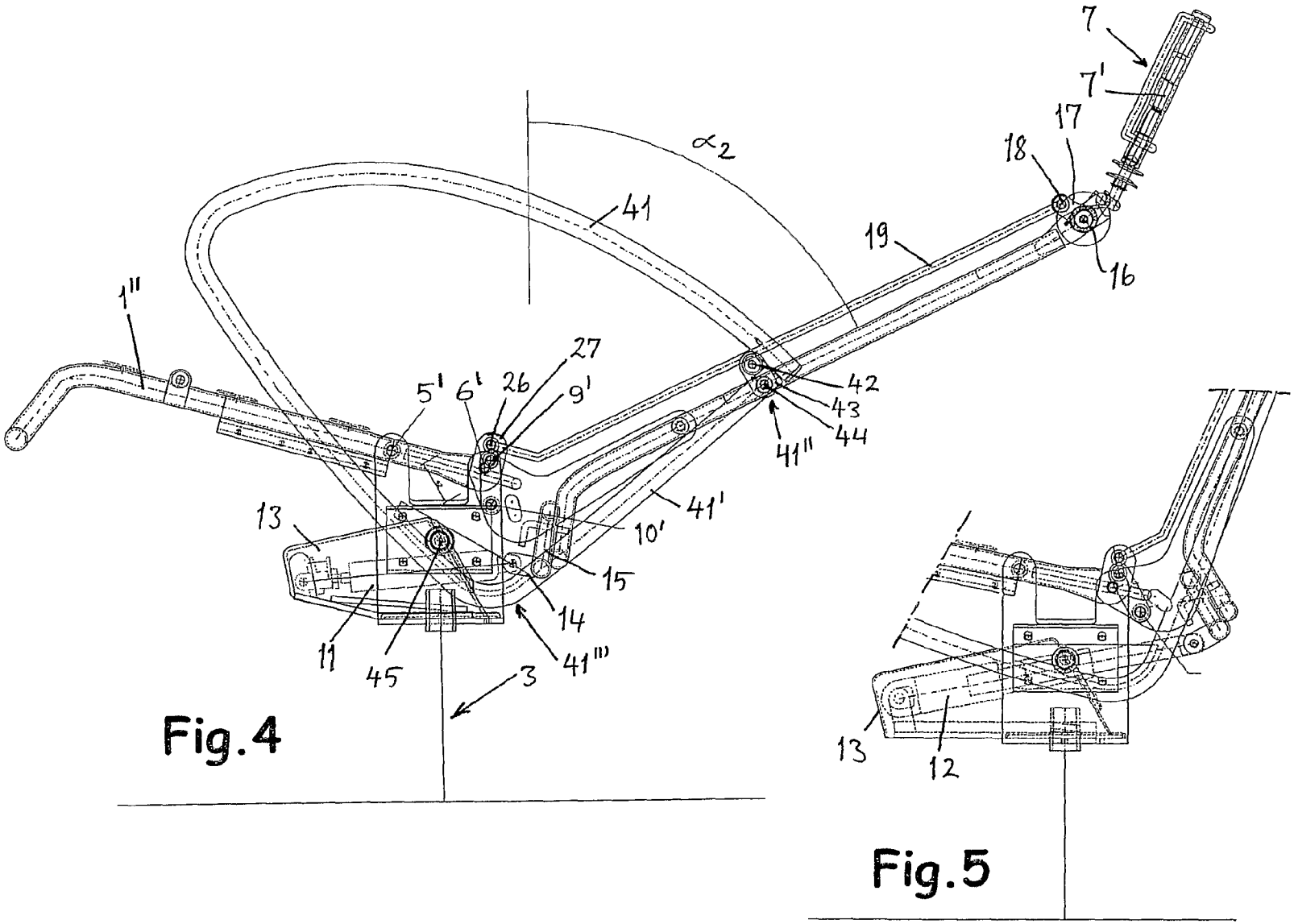
FIG. 4 shows the piece of seating and reclining furniture in FIG. 1 with the seat and the back in a second position relative to one another.
FIG. 5 shows the use of a motor instead of a gas spring for adjusting the angle between the back and the seat of the piece of seating and reclining furniture.

To obtain a coordinated and controlled movement, a link 8 is provided which is pivotally fastened to a rear part 9 of the seat 1 frame 1' and pivotally fastened to a lower part 10 of the back 2 frame 2'. FIGS. 3 and 4 show a link 8' which has a slightly longer length than the link 8 and which is fastened to a rear part 9' of the seat frame 1" and is pivotally fastened to a lower part 10' of the back frame 2'. Common to both solutions is that the pivotal connection 10; 10' of the link 8; 8' to the back frame 2' is located behind and below said rear suspension point 6.

For both solutions of link 8; 8', the pivotal connection of the link to the seat frame 1'; 1" will be located flush approximately in the region of the rear suspension point 6, preferably at a short distance behind the rear suspension point, as shown in FIGS. 1 and 2, or preferably at a short distance above and behind the rear suspension point, as shown in FIGS. 3 and 4.

It will be seen that the configuration and position of the link 8; 8' relative to the suspension points for the seat and the back, respectively, will be determining for the extent to which the seat will tilt backwards when the back tilts backwards. The choices made in this connection could be determined by the typical range of use of the piece of furniture.

To set the angle a between the seat 1 and the back 2, there may be used, for example, a controllable gas spring 11 as shown in FIGS. 1-4, or a controllable electric motor 12 as shown in FIG. 5. In a per se known way, the gas spring 11 or the motor 12 at one end is articulatedly fastened to the base of the piece of furniture 3 by a fitting 13 that is placed between the fittings 4. The other end of the gas spring 11 or the motor 12 is connected to the back 2 and its frame 2' via link 14 and an associated fastener 15.

On studying the position and function of the link 8; 8', it will be understood that when the back 2 moves backwards, the pivotal connection 10; 10' of the link to the back frame 2' will move forwards and downwards, which will then cause the pivotal connection 9; 9' of the link 8; 8' to the rear part of the seat to be pulled downwards so that the seat 1 tilts backwards about the suspension point 5.

The neck rest 7 has a frame 7' which is hinge-connected at 16 to an upper part of the back 2" of the piece of furniture, the neck rest frame at the hinge connection 16 with the back having a forward facing arm 17 which forms an articulated connection 18 with a rod 19 extending down along the back. As shown in FIGS. 1 and 2, the rod 19 is at its lower end articulated to a forward facing arm 20 on an elongate fitting 21, the fitting close to this arm being pivotally connected at 22 to the back frame 2'. The fitting 21 extends forwards towards the forward part of the seat 1 and there is articulated 23 to a tiltable leg/foot rest frame 24. The foot/leg rest frame 24 is pivotally connected at 25 to the forward part of the seat frame, so that on an increase of the angle $\alpha$ between the seat and the back, the neck rest 7 is caused to tilt forwards about the hinge connection 16, whilst the leg rest 24 tilts up.

In the alternative solution shown in FIGS. 3 an 4, where a foot/leg rest is not used, the rod 19 at its lower end is articulated at 26 to an upright arm 27 fastened to the rear part of the seat frame 1", so that an increase in the angle a between the seat and the back tilts the neck rest 7 forwards relative to the back 2 about the hinge connection 16. This happens because the arm 26 is almost stationary in the longitudinal direction of the piece of furniture and, consequently, the rod 19 will cause pulling on the arm 17 and thus tilting of the neck rest 7.

The piece of seating and reclining furniture as shown and explained in connection with FIGS. 1-5 is shown in perspective in FIGS. 6 and 7. The piece of furniture is provided with a foot/leg rest 24 that is pivotally connected at 25 to a forward part of the seat frame, and where a first gas spring, i.e., the gas spring 11, is controllable to cause said angle adjustment, and where a second gas spring 28 is controllable to cause upward tilting of the leg rest 24. The first gas spring 11 and the second gas spring 28 are controllable from one single, common control lever or control handle 29 via a control fitting which has manipulator cable 31; 32 run to the respective gas spring 11; 28. This facilitates the control of the functions of the piece of furniture considerably, i.e., that only one handle is needed for both functions. If the gas spring 11 is replaced by an electric motor drive 12, this single handle solution will be usable with a technical modification. Even in the case where the gas spring 28 is replaced by an electric motor drive, this single handle solution will work. Choice of actuator is therefore not decisive for the single handle principle according to the invention.

Figure 6:
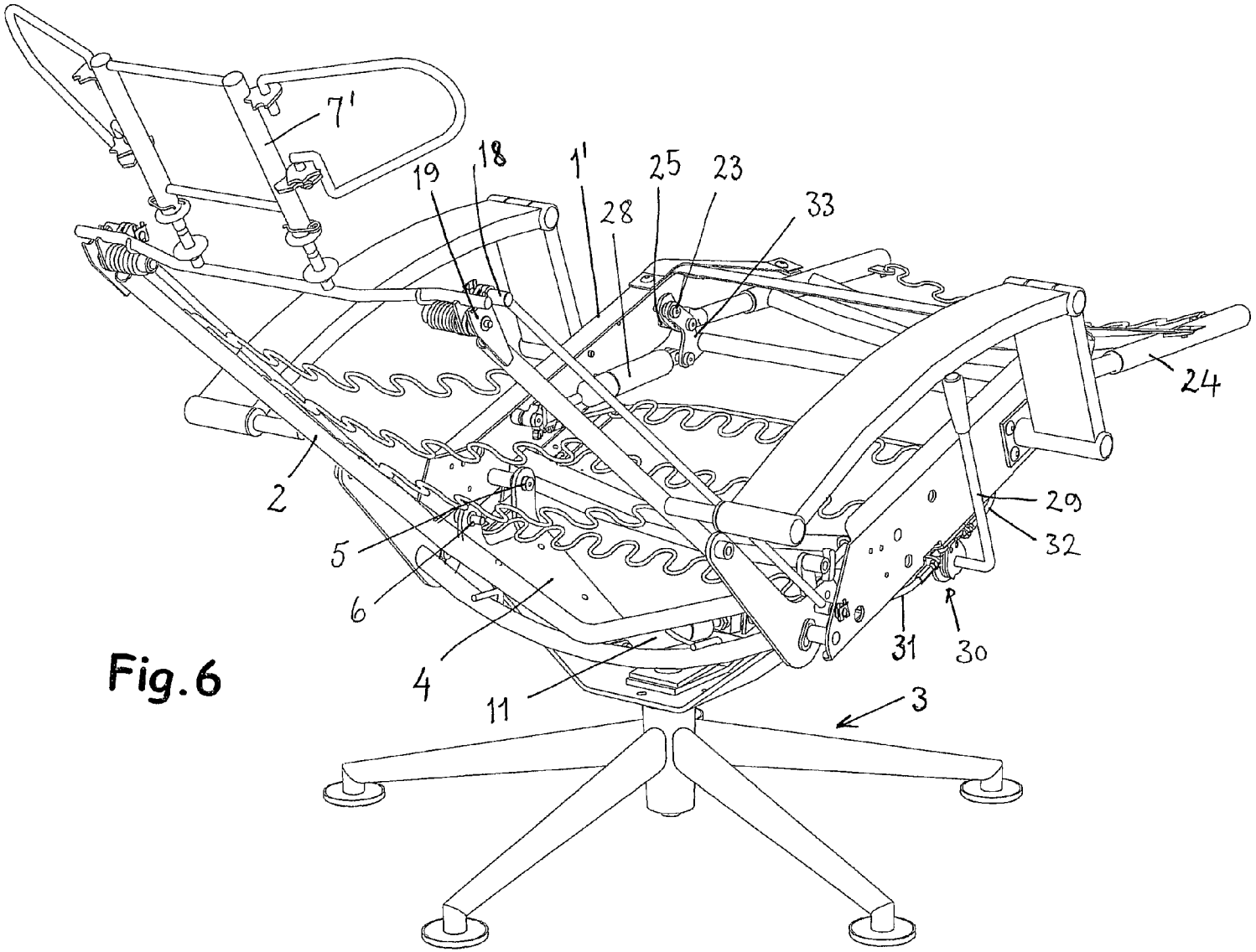
FIGS. 6 and 7 show the adjustable piece of seating and reclining furniture with foot/leg rest seen in perspective from the rear and from the front, respectively.
Figure 7:
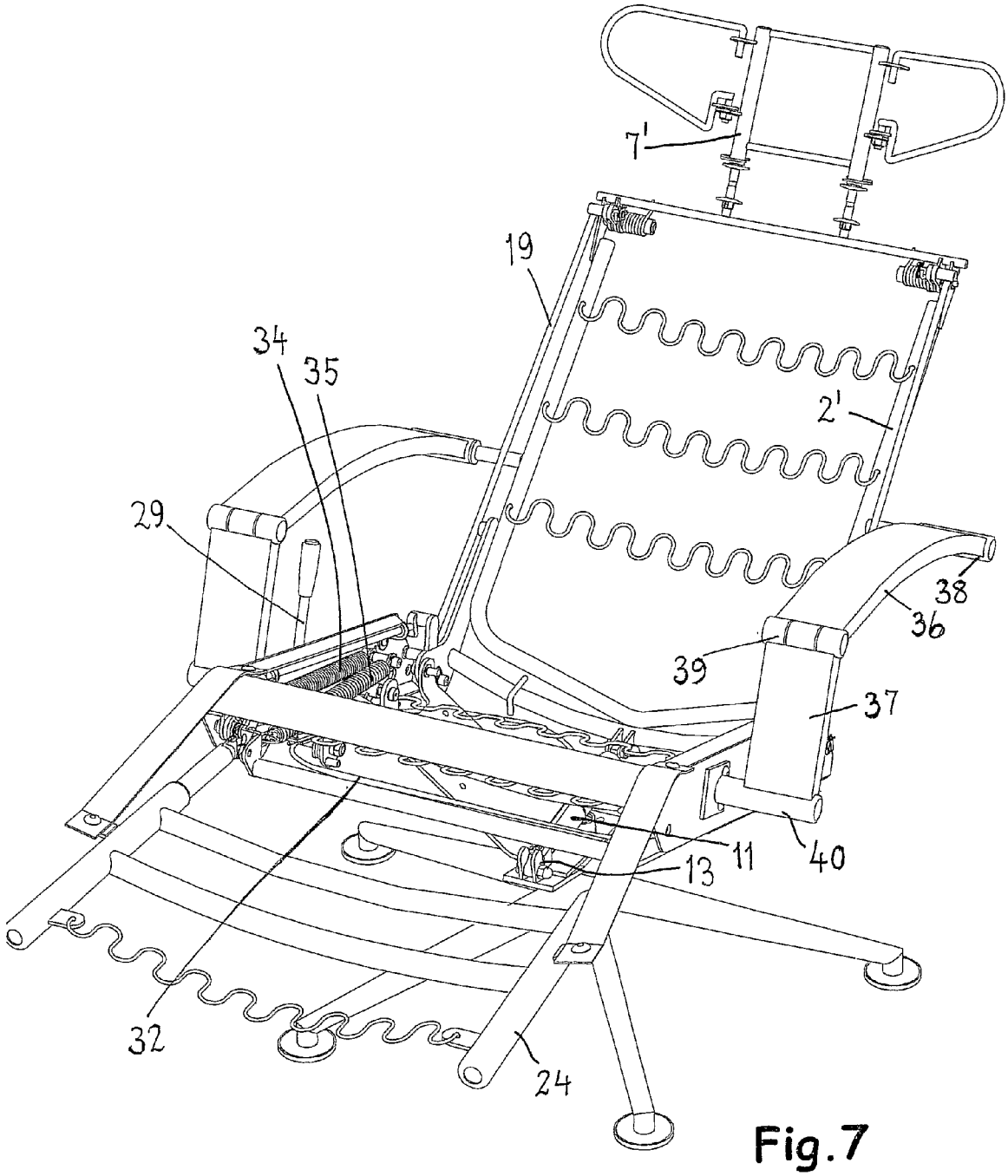

The leg rest 24 is suspended from a dead centre link construction 33, and to assist the gas spring 28 when the leg rest is moved to/from a position of use as shown in FIGS. 6 and 7, it is expedient to allow the foot/leg rest to be biased by springs 34, 35.

As shown in FIGS. 1, 2, 6 and 7, the arms rests of the piece of seating and reclining furniture may consist of two parts 36, 37, the first part 36 extending forward from a pivotal connection 38 with the seat back frame 2' and at its front end being pivotally connected at 39 to a second part 37 which extends downward and is pivotally connected at 40 to the seat frame 1'. It will be seen that the arm rest part 36 will thus be at approximately the same inclination to the seat regardless of the angle between them.

FIGS. 3 and 4 show a slightly different solution as regards the arm rest of the piece of seating and reclining furniture. The arm rest in configured with a hoop-like, for example, almost D-like forward-facing frame 41. The frame has a rear part 41' which, at the top, at 41" is pivotally fastened to a first end 42 of a connecting link 43, the second end 44 of the connecting link being pivotally fastened to the back frame 2'. The rear part of the frame is at the bottom 41'" pivotally connected at a point 45 to a fitting 4 which extends up from the base of the piece of furniture. The frame 41 of the arm rest may, for example, have a D-like configuration where the "upright" 41' of the D has a backward tilted position. The upright 41' is thus at its upper end 41" pivotally fastened to the link 43, the link 43 at its other end being pivotally fastened at 44 to the back frame 2'. The arm rest at a distance forwards from the lower end 41'" of the upright will be pivotally connected at a pivot point 45 to the fitting 4 of the piece of furniture. The most curved portion of the D faces upwards, as can be seen clearly from FIGS. 3 and 4. The curved portion on which a user of the piece of the furniture rests his arms will o have approximately the same position relative to the back when the back is tilted, but will change its position relative to the seat. Although these figures show a D-like configuration of the frame 41, it will be understood that other shapes are conceivable. Of course, the frame will be capable of being padded where the user is to rest his arm, and the frame can also be wholly or partly covered.

The invention claimed is:

1. A device for an adjustable piece of seating and reclining furniture having a seat with a seat frame a back with a back frame and a supporting base, and with an adjustable angle between the seat and the back of the piece of furniture, wherein on each side of the piece of furniture there is located a first fitting projecting upwards from the base, the seat being tiltable about a forward suspension point on the first fitting, and the back being tiltable about a rear suspension point on the first fitting, wherein the back upon tilting backwards causes the seat to tilt backwards, and wherein a first link is pivotally fastened to a rear part of the seat frame and pivotally fastened to a lower part of the back frame, the pivotal connection of the first link to the back frame being behind and below said rear suspension point, and the pivotal connection of the first link to the seat frame is located flush approximately in the region of the rear suspension point.

2. The device of in claim 1, wherein the forward suspension point is higher than the rear suspension point.

3. The device of claim 1, wherein the pivotal connection of the first link to the seat frame is located flush approximately in the region of the rear suspension point and a short distance above and/or behind the rear suspension point.

4. The device of claim 1, wherein a neck rest is arranged on the back of the piece of seating and reclining furniture and the neck rest has a frame that is hinge-connected to an upper part of the back;

the neck rest frame at the hinge connection to the back has a forward facing arm which forms an articulated connection to a rod extending down along the back; and the rod at its lower end is articulated to an upright arm secured to the rear part of the seat frame, so that an increase in the angle between the seat and the back tilts the neck rest forward about the hinge connection relative to the back.

5. The device of claim 1, wherein a neck rest is arranged on the chair back in that the neck rest has a frame that is hinge-connected to an upper part of the chair back;

the neck rest frame at the hinge connection to the back has a forward facing arm which forms an articulated connection with a rod extending down along the back; and the rod at its lower end is articulated to a forward facing arm on an elongate fitting, which elongate fitting close to this arm is pivotally connected to the back frame, the elongate fitting extending forwards towards the forward part of the seat and there being articulated to an upwardly tillable leg rest frame; and the leg rest frame is pivotally connected to the forward part of the seat frame, so that when the angle between the seat and the back is increased, the neck rest is caused to tilt forwards about the hinge connection whilst the leg rest is tilted up.

6. The device of claim 1, wherein, the piece of seating and reclining furniture is provided with a leg rest which is pivotally connected to a forward part of the seat frame;

a first actuator is controllable to cause said angle adjustability between the seat and the back of the piece of furniture;

a second actuator is controllable to cause tilting up of the leg rest; and said first and second actuators are controllable from one single, common control lever or control handle via a control fitting which has manipulator cable run to each actuator.

7. The device of claim 6, wherein the leg rest is spring-biased in connection with a dead center linkage construction.

8. The device of claim 6, wherein the first actuator comprises a gas spring; and the second actuator comprises a gas spring.

9. The device of claim 1, wherein the piece of seating and reclining furniture has arm rests which are each configured as a hoop-like forward facing frame;

the frame has a rear part which at the top is pivotally fastened to a first end of a connecting link, and where the second end of the connecting link is pivotally fastened to the back frame; and the rear part of the frame at the bottom is pivotally connected to the first fitting that extends up from the base of the piece of furniture.

10. The device of claim 9, wherein the arm rest frame has a D-like configuration;

the upright of the D has a backward tilted position;

the upright at its upper end is pivotally fastened to a first end of a connecting link, the second end of the connecting link being pivotally fastened to the back frame, and the arm rest at a distance forward from the lower end of the upright is pivotally connected to the first fitting which extends up from the base of the chair; and the D has a curved portion that faces upwards to form a resting portion for a chair user's arm.

* * * * *